United States Patent [19]

Horii

[11] Patent Number: 5,052,672

[45] Date of Patent: Oct. 1, 1991

[54] PAPER FEEDING DEVICE HAVING A SUCTION MEMBER DRIVEN BY A FOUR-BAR LINKAGE ARRANGEMENT

[75] Inventor: Yoshiyuki Horii, Kyoto, Japan

[73] Assignee: Horizon International, Inc., Shiga, Japan

[21] Appl. No.: 527,522

[22] Filed: May 23, 1990

[30] Foreign Application Priority Data

Sep. 12, 1989 [JP] Japan ..... 1-107087[U]

[51] Int. Cl.[5] ..... B65H 3/44

[52] U.S. Cl. ..... 271/9; 271/11; 271/107; 271/31; 271/152; 414/797; 414/917

[58] Field of Search ..... 271/9, 10, 90, 95, 105–107, 271/104, 30.1, 31, 37, 42, 130, 132, 115, 128, 152, 158, 159, 102, 100, 11, 14, 5; 414/732, 733, 797, 917

[56] References Cited

U.S. PATENT DOCUMENTS

| | | | |
|---|---|---|---|
| 2,084,065 | 6/1937 | Reinartz | 271/5 X |
| 2,183,077 | 12/1939 | Kast | 271/31 |
| 3,199,863 | 8/1965 | Muller | 414/797 X |
| 3,370,845 | 2/1968 | Newcomb | 271/107 |
| 3,980,292 | 9/1976 | Sakurai | 271/107 X |
| 4,350,330 | 9/1982 | Brown | 271/30.1 X |
| 4,589,649 | 5/1986 | Prescher | 271/107 |
| 4,618,135 | 10/1986 | Greiner et al. | 271/9 |

FOREIGN PATENT DOCUMENTS

| | | | |
|---|---|---|---|
| 276120 | 10/1964 | Australia | 271/93 |
| 38854 | 5/1928 | Denmark | 271/107 |
| 545325 | 2/1932 | Fed. Rep. of Germany | 271/107 |
| 549730 | 4/1932 | Fed. Rep. of Germany | 271/107 |
| 618724 | 8/1935 | Fed. Rep. of Germany | 271/107 |
| 623580 | 12/1935 | Fed. Rep. of Germany | 271/95 |
| 729011 | 11/1942 | Fed. Rep. of Germany | 271/104 |
| 31547 | 10/1961 | Finland | 414/797 |
| 598302 | 12/1925 | France | 271/107 |
| 927194 | 10/1947 | France | 271/107 |
| 4028052 | 12/1963 | Japan . | |
| 47-16086 | 5/1972 | Japan . | |
| 145271 | 12/1978 | Japan | 271/90 |
| 66483 | 1/1926 | Sweden | 271/107 |
| 34395 | 2/1931 | United Kingdom | 271/107 |
| 472109 | 9/1937 | United Kingdom | 271/107 |
| 484018 | 4/1938 | United Kingdom | 271/107 |
| 521669 | 5/1940 | United Kingdom | 271/107 |

*Primary Examiner*—Joseph E. Valenza
*Assistant Examiner*—Boris Milet
*Attorney, Agent, or Firm*—Morgan & Finnegan

[57] ABSTRACT

A paper feeding device for a collator is provided wherein a drive mechanism for moving suction heads between the upper surface of a stack on a paper supply shelf and feed rollers disposed at a paper feeding station in front of the paper supply shelf includes a four-bag linkage mechanism pivotally carried at a horizontally extending pivot. The four-bar linkage machanism comprises four elemental links pivotally connected tail-to-head in a closed loop, one pair of the adjacent links being pivotally carried at the pivot, one of the other pair of the adjacent elementary links supporting the suction heads. The two elemental links pivotally carried at the pivot are synchronously oscillated about the pivot to produce a composite movement at the elemental link supporting the suction head whereby the suction heads moves the upper surface and the feed rollers.

2 Claims, 3 Drawing Sheets

PAPER FEEDING DEVICE HAVING A SUCTION MEMBER DRIVEN BY A FOUR-BAR LINKAGE ARRANGEMENT

BACKGROUND OF THE INVENTION

This invention relates to a paper feeding device for a collator.

In a conventional type of paper feeding device for a collator, a plurality of paper supply shelves are arranged in parallel spaced relationship with one another in a vertical direction and a stack of paper sheets to be collated is supported on each of the paper supply shelves so that the top sheet in the stack is successively removed from the stack. Feed rollers are disposed at the respective feeding stations in front of the paper supply shelves. Then during each collation cycle, a sequence of paper feeding operations which successively proceeds from the uppermost paper supply shelf through the lowermost paper supply shelf is performed by moving the suction heads between the upper surface of the top sheet in the stack and the feed rollers by a common drive mechanism at each paper supply shelf, so that the paper sheets are fed into the collator one by one from each paper supply shelf. Thus, in such drive mechanism, the respective suction heads of the paper supply shelves is not moved independently and then the suction heads of the uppermost paper supply shelf does not start the movement for the following paper feeding operation until the paper feeding operation by the suction heads of the lowermost paper supply shelf is finished. As a result the following collation cycle can not be started in proceeding a collation cycle.

On the other hand for the purpose of achieving a high speed collating operation, it is necessary to start the following collation cycle in proceeding a collation cycle. In order to this end, the drive mechanisms for the suction heads need being able to independently move the respective suction heads of the paper supply shelves in such a manner that the suction heads of the uppermost paper supply shelf starts the movement for the following paper feeding operation before the suction heads of the lowermost paper supply shelf finishes the paper feeding operation.

However, in the prior art, the drive mechanisms which can independently move the respective suction heads of the paper supply shelves is so complex that a larger space for containing such drive mechanisms is required.

SUMMARY OF THE INVENTION

It is the object of the invention to provide a paper feeding device comprising a compact drive mechanism which can independently move the respective suction heads of the paper supply shelves so as to adapt for above-mentioned high speed collating operation.

Accordingly, the invention provides a paper feeding device comprising a frame; a paper supply shelf arranged for substantially vertical movement, said paper supply shelf supporting a stack of paper sheets to be collated thereon; means for urging said paper supply shelf upwardly; stop means engageable with the top sheet in said stack for defining the upper limit of the movement of said paper supply shelf with said stack in such a manner that the top sheet is always positioned at a predetermined picking-up level; feed roller means disposed at a paper feeding station in front of the top sheet which is positioned at said predetermined picking-up level; suction means movable between a first position whereat said suction means is engageable with the upper surface of the top sheet in said stack at said picking-up level so as to remove said top sheet from said stack and a second position whereat said suction means is located close to said feed roller means adapted to transfer said removed paper sheet to said feed roller means; drive means for moving said suction means between said first position and said second position, said drive means comprising a four-bar linkage mechanism pivotally carried at a horizontally extending pivot, said four-bar linkage mechanism comprising four elemental links pivotally connected one by one to form a closed loop, the first elemental link being connected to said suction means, the second elemental link being pivotally carried at said pivot and pivotally connected to said first elemental link and the third elemental link, the third elemental link being pivotally carried at said pivot, the fourth elemental link being connected at its opposite ends to said first and third elemental links, respectively, said driving means further including means for synchronously oscillating said second and third elemental links about said pivot to produce a composite movement at said first elemental link whereby said suction means may be moved between said first position and said second position.

In the preferred embodiment, said drive means for moving said suction means between said first position and said second position further comprises a first peripheral cam for oscillating said second elemental link about said pivot through a roller attached to said second elemental link; means for urging said roller of said second elemental link toward the edge of said first peripheral cam; a second peripheral cam for oscillating said third elemental link through a roller attached to said third elemental link; means for urging said roller of said third elemental link toward the edge of said second peripheral cam; means for operatively connecting said first peripheral cam with said second peripheral cam.

In another embodiment, said means for operatively connecting said first peripheral cam with said second peripheral cam comprises a common drive camshaft on which said first and second cams are mounted for synchronous rotation.

Furthermore the invention provides a paper feeding device assembly comprising a plurality of paper feeding device units, each of said paper feeding device units including a frame; a paper supply shelf arranged for substantially vertical movement, said paper supply shelf supporting a stack of paper sheets to be collated thereon; means for urging said paper supply shelf upwardly; stop means engageable with the top sheet in said stack for defining the upper limit of the movement of said paper supply shelf with said stack in such a manner that the top sheet is always positioned at a predetermined picking-up level; feed roller means disposed at a paper feeding station in front of the top sheet which is positioned at said predetermined picking-up level; suction means movable between a first position whereat said suction means is engageable with the upper surface of the top sheet in said stack at said picking-up level so as to remove said top sheet from said stack and a second position whereat said suction means is located close to said feed roller means adapted to transfer said removed paper sheet to said feed roller means; drive means for moving said suction means between said first position and said second position, said drive means comprising a four-bar linkage mechanism pivotally carried at a horizontally extending pivot, said four-bar linkage mechanism comprising four elemental links pivotally connected one by one to form a closed loop, the first elemental link being connected to said suction means, the second elemental link being pivotally carried at said pivot and pivotally connected to said first elemental link and the third elemental link, the third elemental link being pivotally carried at said pivot, the fourth elemental link being connected at its opposite ends to said first and third elemental links, respectively, said driving means further including means for synchronously oscillating said second and third elemental links about said pivot to produce a composite movement at said first elemental link whereby said suction means may be moved between said first position and said second position; a common drive source for selectively driving said feed roller means and said drive means of said plurality of paper feeding device units.

In the preferred embodiment of such paper feeding device assembly, each said drive means for moving said suction means between said first position and said second position of said plurality of paper feeding device units further comprises a first peripheral cam for oscillating said second elemental link about said pivot through a roller attached to said second elemental link; means for urging said roller of said second elemental link toward the edge of said first peripheral cam; a second peripheral cam for oscillating said third elemental link through a roller attached to said third elemental link; means for urging said roller of said third elemental link toward the edge of said second peripheral cam; means for operatively connecting said first peripheral cam with said second peripheral cam.

In the further embodiment of such paper feeding device assembly, each said means for operatively connecting said first peripheral cam with said second peripheral cam of said plurality of paper feeding device units comprises a common drive camshaft on which said first and second cams are mounted for synchronous rotation.

BRIEF DESCRIPTION OF THE DRAWINGS

The invention will be described in more detail with reference to preferred embodiments illustrated in the accompanying drawings, in which.

DESCRIPTION OF PREFERRED EMBODIMENTS

Figure 1:
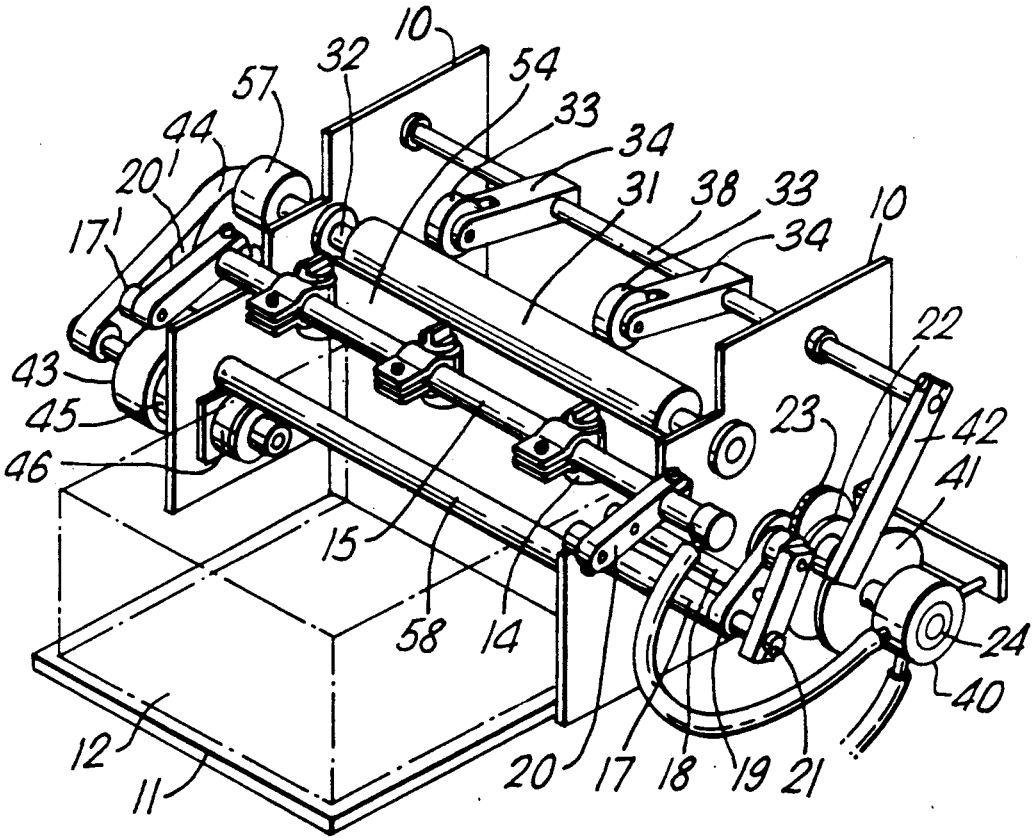
FIG. 1 is a perspective view showing the preferred embodiment of the paper feeding device according to the invention.
Figure 2:
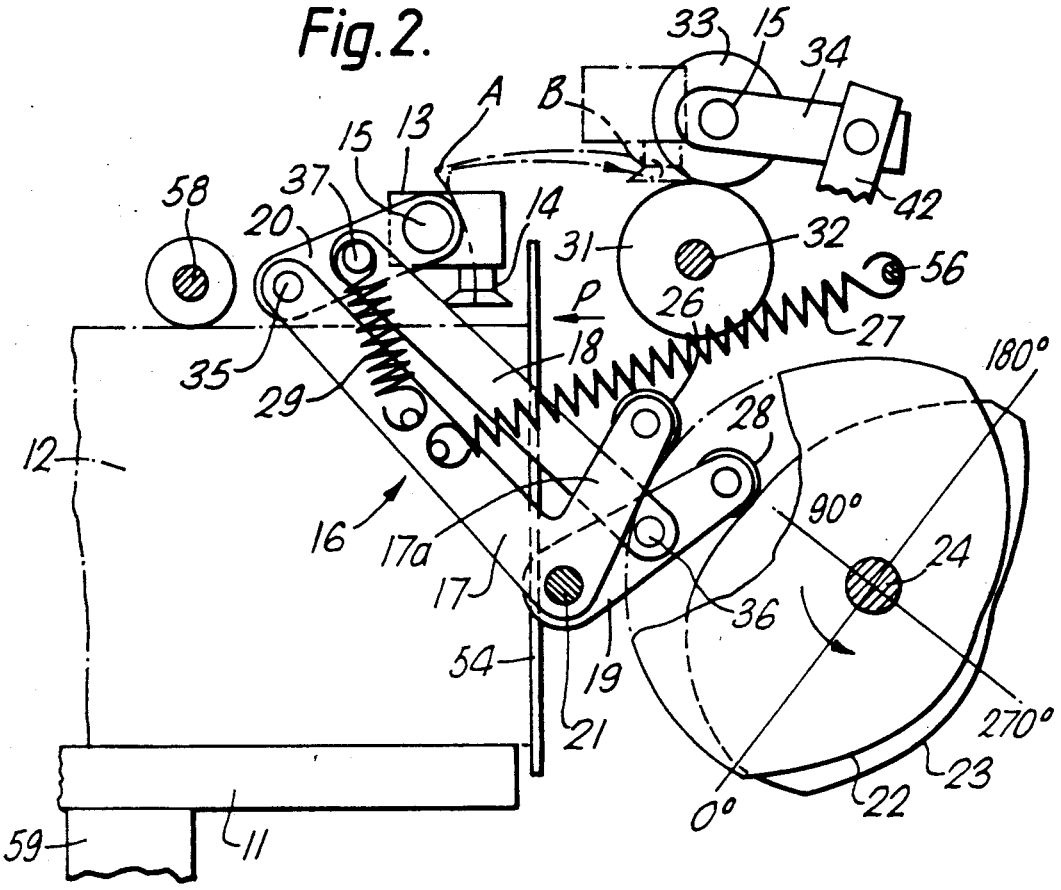
FIG. 2 is a schematic side view of the device shown in FIG. 1 with some parts being omitted for clarity.

Referring now to FIG. 1 and FIG. 2, the numeral 11 designates a paper supply shelf on which a stack of paper sheets 12 to be collated is supported. And the paper supply shelf 11 is supported by the actuator 59 at the lower surface thereof. The actuator 59 guides the paper supply shelf 11 for vertical movement and always urges the paper supply shelf 11 upwardly. At both sides of the paper supply shelf 11, a side plate 10 which is a part of a frame is disposed perpendicular to the paper supply shelf 11 and a vertical front plate 54 is attached between the side plates 10, 10 before the front end of the paper supply shelf 11. The front plate 54 serves as a stopper to control the front ends of paper sheets in setting the paper sheets in position. A stopper in the form of an idle roller 58 is supported between the side plates 10; 10 above nearly the center of the stack. The roller 58 is engageable with the top sheet in the stack 12 to define the upper limit of the movement of the top sheet so that the top sheet is always positioned at a predetermined picking-up level during a paper feeding operation. Thus as the paper sheet is removed from the stack 12 during the paper feeding operation, the paper supply shelf 11 is lifted by degrees so that the top sheet of the stack 12 is always positioned at the predetermined picking-up level somewhat lower than the level of the upper end of the front plate 54.

At the outside of one of the side plates 10, a four-bar linkage mechanism 16 is pivotally carried at a horizontally extending pivot 21 which is supported between the side plates 10 for rotation about its axis. The four-bar linkage mechanism 16 comprises four elemental links pivotally connected tail-to-head in a closed loop, the first elemental link 20 being pivotally connected to the second elemental link 17 at a pin joint 35, the second elemental link 17 being pivotally carried at the pivot 21 and pivotally connected to the third elemental link 19, the third elemental link 19 being pivotally carried at the pivot 21, the fourth elemental link 18 pivotally connected at its opposite ends to the first and third elemental links 20, 19 at a pin joints 37 and 36, respectively. Then the second elemental link 17 is fixed to the pivot 21 so as to oscillate about the axis of the pivot 21, and the third elemental link 19 are mounted on the periphery of pivot 21 to oscillate about the axis of the pivot 21 independently of the pivot 21. Thus the first elemental link 20 oscillates about the pin joint 35 when the third elemental link 19 oscillates and the second elemental link 17 remains stationary, while the forward end of the first elemental link 20 moves forwardly and backwardly with the oscillation of the fourth elemental link 18 about the pin joint 36 when the second elemental link 17 oscillates and the third elemental link 19 remains stationary.

And the second elemental link 17 has an extension **17*a* elongating from the pivot 21 so that the extension 17*a* is at a predetermined angle with the second elemental link body 17 with respect to the axis of the pivot 21. The third elemental link 19 also has an extension elongating from the pin joint 36 toward the outside of the four-bar linkage mechanism 16 parallel to the axis of the third elemental link 19. Also the first elemental link 20 has an extension elongating from the pin joint 37 toward the outside of the four-bar linkage mechanism 16 parallel to the axis of the first elemental link 20**.

Furthermore, at the outside of the opposite side plate 10, a supplementary link 20', which corresponds to the first elemental link 20, is connected to the pivot 21 through a link 17'. In this case, the link 17' is fixed to the pivot 21 while the supplementary link 20' is pivotally connected to the link 17'. A pipe 15 is supported between the forward ends of the links 20, 20'. One or more suction heads 13, three suction heads in the preferred embodiment, are attached to the pipe 15 in an equal interval. The pipe 15 acts as a support for the suction heads 13 and a suction pipe for applying suction force to the suction heads 13. Each of the suction heads 13 is provided with a suction cup 14 of rubber at its lower end surface and is used for suction of the top sheet of the stack 12.

In this respect, the links 17' and 20' are provided for reinforcing the support for the pipe 15 with the suction heads 13. And an alternative arrangement is possible, wherein the pipe 15 is supported by only the first elemental link 20 and the supplement link 20' and the link 17' are not used (see FIG. 4). At that time the pivot 21 is attached to only one of the side plates 10 at one end thereof for rotation about its axis and the links 17, 19 are connected to the other end of the pivot 21 in the same manner that the pivot 21 is supported between the side plates 10.

The numeral 31 denotes a driving roller which is supported between the side plates 10 at a paper feeding station which is positioned in front of the upper end of the front plate 54. The driving roller 31 is always rotated by the rotation of an axis of a driving shaft 32. A shaft 38 is supported between the side plates 10 before the driving roller 31 for rotation about its axis and one or more idle rollers 33, two idle rollers in the preferred embodiment, are attached to the shaft 38 through the respective arms 34 in spaced relationship to one another.

At the same side that the four-bar linkage mechanism 16 is positioned, a first peripheral cam 22 for oscillating the second elemental link 17 and a second peripheral cam 23 for oscillating the third elemental link 19 are mounted on a common drive camshaft 24 for synchronous rotation. The camshaft 24 is supported between the side plates 10 before the front plate 54 for rotation about its axis. The extension 17*a* of the second elemental link 17 is provided with a roller 26 at a forward end thereof and the extension of the third elemental link 19 is provided with a roller 28 at the other end thereof. With reference to FIG. 2, the second elemental link 17 with the extension 17*a* is biased clockwise around the pivot 21 by the resilient force of a spring 27 attached between a fixed shaft 56 which is fixed to the side plate 10 and the middle portion of the second elemental link 17 so that the roller 26 of the second elemental link 17 is urged toward the edge of the first peripheral cam 22. And the third elemental link 19 is also biased clockwise around the pivot 21 by the resilient force of a spring 29 attached between the middle portion of the second elemental link 17 and the joint 37 so that the roller 28 of the third elemental link 19 is urged toward the edge of the second peripheral cam 23. Then the second elemental link 17 with its extension 17*a* acts as a follower arm for the first peripheral cam 22 while the third elemental link 19 acts as a follower arm for the second peripheral cam 23.

Figure 3:
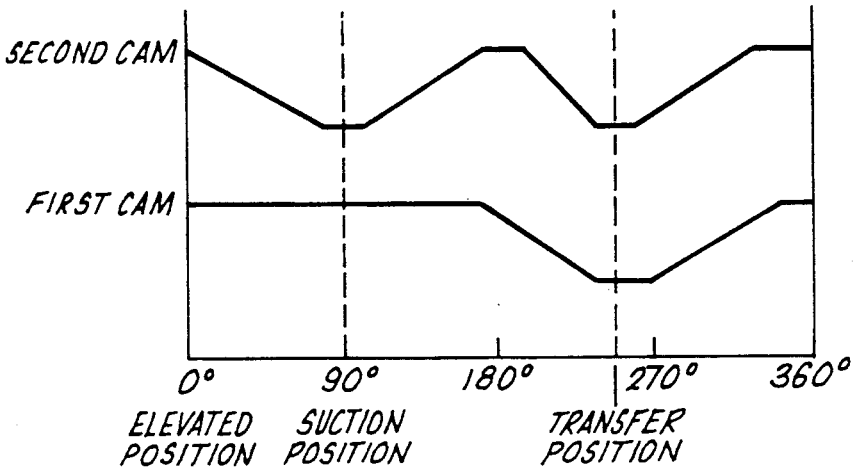
FIG. 3 is a cam diagram of the device shown in FIG. 1.

Thus the third elemental link 19 is oscillated by the rotation of the second peripheral cam 23 and the suction heads 13 are lifted and lowered, while the second elemental link 17 is oscillated by the rotation of the first peripheral cam 22 and the suction heads 13 are moved in a forward and backward direction. FIG. 3 is a cam diagram of the cams 22, 23.

Furthermore, at the same side that the cams 22, 23 are arranged, a peripheral cam 41 is mounted on the camshaft 24 and a follower arm 42 for the cam 41 is fixed to an end of the shaft 38. The follower arm 42 is urged toward the edge of the cam 41 by the resilient force of a spring not shown. Thus the oscillation of the follower arm 42 by the cam 41 is interlocked with the oscillation of the arms 34 trough the shaft 38. Consequently, the idle rollers 33 move between a position whereat they are pressed against the driving roller 31 and a position whereat they separate upwardly from the driving roller 31.

Thus, when the paper feeding operation is started, the cams 22, 23 are positioned at the initial position and the suction heads 13 are positioned at an elevated position A whereat the suction cups 14 upwardly retract from the upper surface of the stack 12. Then the cams 22, 23 are rotated counterclockwise about the axis of the common drive camshaft 24 (see FIG. 2). Referring to FIGS. 2 and 3, first, in the range from 0° through 90° in FIG. 3, the third elemental link 19 is oscillated clockwise about the axis of the pivot 21 with the rotation of the second peripheral cam 23 while the second elemental link 17 is stationary though the first peripheral cam 22 is rotated. As a result, the fourth elemental link 18 is lowered and the suction heads 13 are lowered to the suction position shown in FIG. 2 whereat the suction cups 14 can engage with the forward end portion of the top sheet in the stack 12 at the picking-up level so as to remove the top sheet from the stack 12.

During such lowering movement of the suction heads 13 a rotary valve 40 (see FIG. 1) is rotated with the rotation of the axis of the shaft 24 and consequently the suction force is applied to the suction heads 13, namely the suction cups 14.

At that time air is applied under pressure along the direction of arrow P so that the top sheet in the stack 12 is floated up from the stack 12 and sucked by the suction cups 14.

In the range from 90° through 180° in FIG. 3, the third elemental link 19 is oscillated counterclockwise about the pivot 21 while the second elemental link 17 is stationary. Consequently the fourth elemental link 18 is lifted and the suction heads 13 move to the elevated position A again.

In the range from 180° through 270° in FIG. 3, the crank 17 is oscillated counterclockwise about the axis of the pivot 21 and the suction heads 13 are advanced and at the same time the third elemental link 19 is oscillated clockwise about the axis of the pivot 21, so that the suction heads 13 are moved to the transfer position B shown by the chain line in FIG. 2 whereat the suction heads 13 is located close to the driving roller 31 adapted to transfer the paper sheet removed from the stack 12 to the collator.

The transfer position B is straight ahead of the driving roller 31 and the leading edge of the paper sheet transported by the suction heads 13 reaches to the top surface of the driving roller 31. Then the suction heads 13 cut off the suction air and simultaneously the idler roller 33 is lowered through the swing movement of the follower arm 42 with the rotation of the cam 41, so that the paper sheet is nipped between the roller 31 and the roller 33 and moved into the collator.

Thereafter the paper sheet is fed from the paper feed rollers 31, 33 into the collating section of the collator in a conventional manner, for example by means of being transported by a feeding belt.

Further rotation of the cams 22, 23 causes the suction heads 13 to return back to the elevated position A and then the rotation of the cams 22, 23 is stopped. Thus the paper feeding operation is finished.

With respect to a drive mechanism for the common drive camshaft 24, in the preferred embodiment, a pulley 52 is mounted on the camshaft 24 at the outside of the side plate 10 opposite to the side plate 10 at which the cams 22, 23 are arranged. And a composite pulley 43 is also attached to the side plate 10 at the same side as the side at which the pulley 52 ia arranged. The composite pulley 43 comprises of a rotating shaft 43c which is horizontally attached to the frame 10 for rotation about its axis, and a first pulley 43a fixed to the rotating shaft 43c and a second pulley 43b mounted on the rotating shaft 43c through a clutch 45. The first pulley 43a of the composite pulley 43 and the pulley 52 of the camshaft 24 are operatively connected through a belt 44. The second pulley 43b of the composite pulley 43 is operatively connected to a drive source 50 such as a motor through a driving belt 51 (see FIG. 4). A clutch 45 is adapted for the connection and disconnection between the pulley 43b and the rotating shaft 43c in the torque. A brake 46 is also arranged to stop the rotation of the pulley 43b when the clutch 45 releases the engagement of the pulley 43b with the shaft 43c. Thus when the clutch 45 is actuated to engage the pulley 43B with the shaft 43C and the brake 46 is released, the torque is transmitted from the drive source 50 to the pulley 52 of the camshaft 24 through the composite pulley 43 and consequently the cams 22, 23 and 41 are rotated.

When the cams 22, 23 are rotated by one revolution, a dog 53 which is rotated with the cams 22, 23 actuates a sensor 47 (see FIG. 4) and then the clutch 45 is actuated to release the second pulley 43b from the engagement with the shaft 43c while the brake 46 is actuated to stop the rotation of the shaft 43c.

Figure 4:
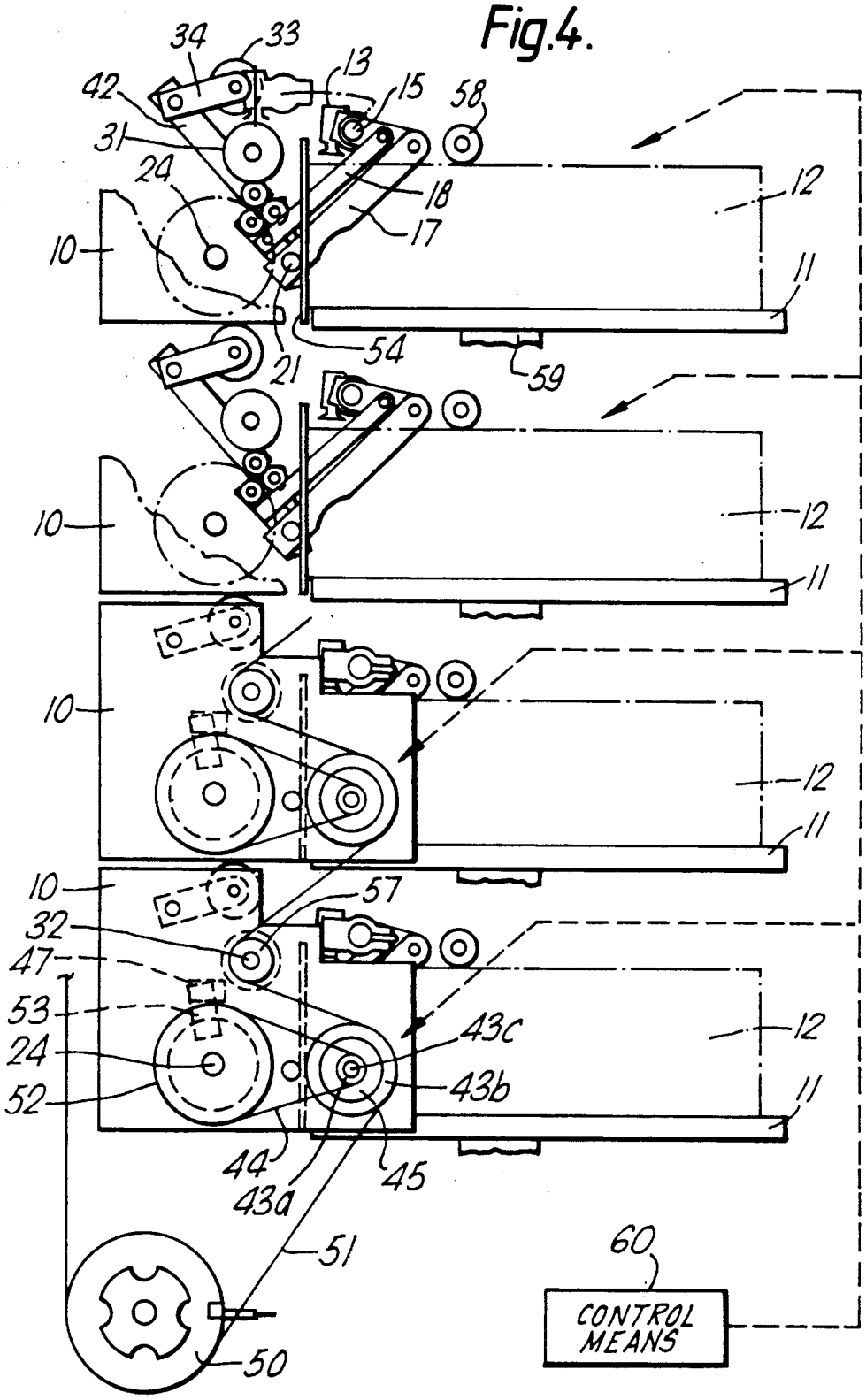
FIG. 4 is a schematic side view showing the preferred embodiment of a paper feeding device assembly according to the invention.

FIG. 4 illustrates the preferred embodiment of a paper feeding device assembly comprising a plurality of paper feeding device units each of whose structure is identical with that of the above-mentioned paper feeding device according to the invention. In FIG. 4, for clarity a side plate 10 is partially cut away at the uppermost paper supply shelf and the next paper supply shelf.

Referring to FIG. 4, a plurality of the paper feeding device units are arranged in parallel spaced relationship with one another in a vertical direction. A single drive source 50 such as a motor is disposed beneath the lowermost paper feeding device unit. The paper feeding device units are operatively connected to the motor 50, respectively by a driving belt 51 which forms a closed loop extending from the motor 50 through the composite pulleys 43 and pulleys 57 mounted on the shafts 32 of the paper feeding device units, back to the motor 50. Then control means 60 which comprises a central processing unit is arranged for selectively actuating the respective pairs of the clutch 45 and the brake 46 of the paper feeding device units so that the respective suction heads of the paper feeding device units can be independently moved. And a sequence of the paper feeding operations which successively proceeds from the uppermost paper supply shelf through the lowermost paper supply shelf is performed during each collation cycle and the paper feeding operation for the following collation cycle is started in proceeding the paper feeding operation for a collation cycle. Consequently, a high speed collating operation is easily achieved.

As described so far in detail, in the paper feeding device according to the invention, the drive mechanism for moving the suction heads has a compact construction comprising the four-bar linkage mechanism and can be arranged at each paper supply shelf. Moreover, even if a plurality of paper supply shelves are arranged, the timing of paper feeding operation can be controlled independently at each paper supply shelf, which leads to the high speed paper collating operation.

What is claimed is:

1. A paper feeding device comprising:

a frame;

a paper supply shelf arranged for substantially vertical movement, said paper supply shelf supporting a stack of paper sheets to be collated thereon;

means for urging said paper supply shelf upwardly;

stop means engageable with the top sheet in said stack for defining the upper limit of the movement of said paper supply shelf with said stack in such a manner that the top sheet is always positioned at a predetermined picking-up level;

feed roller means disposed at a paper feeding station in front of the top sheet which is positioned at said predetermined picking-up level;

suction means movable between a first position whereat said suction means is engageable with the upper surface of the top sheet in said stack at said picking-up level so as to remove said top sheet from said stack and a second position whereat said suction means is located close to said feed roller means adapted to transfer said removed paper sheet to said feed roller means;

drive means for moving said suction means between said first position and said second position, said drive means comprising a four-bar linkage mechanism pivotally carried at a horizontally extending pivot, said four-bar linkage mechanism comprising four elemental links pivotally connected one by one to form a closed loop, the first elemental link being connected to said suction means, the second elemental link being pivotally carried at said pivot and pivotally connected to said first elemental link and the third elemental link, the third elemental link being pivotally carried at said pivot, the fourth elemental link being connected at its opposite ends to said first and third elemental links, respectively, said drive means further including means for synchronously oscillating said second and third elemental links about said pivot to produce a composite movement at said first elemental link, whereby said suction means may be moved between said first position and said second position, said means for synchronously oscillating comprising a first peripheral cam for oscillating said second elemental link about said pivot through a roller attached to said second elemental link;

means for urging said roller of said second elemental link toward the edge of said first peripheral cam;

a second peripheral cam for oscillating said third elemental link through a roller attached to said third elemental link;

means for urging said roller of said third elemental link toward the edge of said second peripheral cam;

means for operatively connecting said first peripheral cam with said second peripheral cam wherein said means for operatively connecting said first peripheral cam with said second peripheral cam comprises a common drive camshaft on which said first and second cams are mounted for synchronous rotation, and;

a further cam mounted on said common drive camshaft for driving said feed roller means.

2. A paper feeding device assembly comprising:

a plurality of paper feeding device units, each of said paper feeding device units including a frame; a paper supply shelf arranged for substantially vertical movement, said paper supply shelf supporting a stack of paper sheets to be collated thereon; means for urging said paper supply shelf upwardly; stop means engageable with the top sheet in said stack for defining the upper limit of the movement of said paper supply shelf with said stack in such a manner that the top sheet is always positioned at a predetermined picking-up level; feed roller means disposed at a paper feeding station in front of the top sheet which is positioned at said predetermined picking-up level; suction means movable between a first position whereat said suction means is engageable with the upper surface of the top sheet in said stack at said picking-up level so as to remove said top sheet from said stack and a second position whereat said suction means is located close to said feed roller means adapted to transfer said removed paper sheet to said feed roller means; drive means for moving said suction means between said first position and said second position, said drive means comprising a four-bar linkage mechanism pivotally carried at a horizontally extending pivot, said four-bar linkage mechanism comprising four elemental links pivotally connected one by one to form a closed loop, the first elemental link being connected to said suction means, the second elemental link being pivotally carried at said pivot and pivotally connected to said first elemental link and the third elemental link, the third elemental link being pivotally carried at said pivot, the fourth elemental link being connected at its opposite ends to said first and third elemental links, respectively, said drive means further including means for synchronously oscillating said second and third elemental links about said pivot to produce a composite movement at said first elemental link whereby said suction means may be moved between said first position and said second position, said means for synchronously oscillating comprising a first peripheral cam for oscillating said second elemental link about said pivot through a roller attached to said second elemental link;

means for urging said roller of said second elemental link toward the edge of said first peripheral cam;

a second peripheral cam for oscillating said third elemental link through a roller attached to said third elemental link;

means for urging said roller of said third elemental link toward the edge of said second peripheral cam;

means for operatively connecting said first peripheral cam with said second peripheral cam, wherein each said means for operatively connecting said first peripheral cam with said second peripheral cam of said plurality of paper feeding device units comprises a common drive camshaft on which said first and second cams are mounted for synchronous rotation;

a further cam mounted on said common drive camshaft for driving said feed roller means; and a common drive source for selectively driving said feed roller means and said drive means of said plurality of paper feeding device units.

* * * * *

UNITED STATES PATENT AND TRADEMARK OFFICE

CERTIFICATE OF CORRECTION

PATENT NO. : 5,052,672

DATED : October 1, 1991

INVENTOR(S) : Yoshiyuki Horii

It is certified that error appears in the above-identified patent and that said Letters Patent is hereby corrected as shown below:

On the title page, item (56):

"References Cited", the following additional references are cited:

FOREIGN PATENT REFERENCES

| | | |
|---|---|---|
| 2381701 | 10/1978 | France |
| 2500222 | 3/1976 | Fed. Rep. of Germany |
| 3135588 | 5/1982 | Fed. Rep. of Germany |
| 3048716 | 9/1981 | Fed. Rep. of Germany |

Signed and Sealed this

Ninth Day of November, 1993

*Attest:*

*Attesting Officer*

Bruce Lehman

BRUCE LEHMAN

*Commissioner of Patents and Trademarks*